US010317147B2

(12) United States Patent
Mutou et al.

(10) Patent No.: US 10,317,147 B2
(45) Date of Patent: Jun. 11, 2019

(54) TANK AND HEAT EXCHANGER

(71) Applicant: DENSO CORPORATION, Kariya, Aichi-pref. (JP)

(72) Inventors: Ken Mutou, Kariya (JP); Takeshi Okinotani, Kariya (JP); Syunsuke Tsubota, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 108 days.

(21) Appl. No.: 15/550,946

(22) PCT Filed: Mar. 18, 2016

(86) PCT No.: PCT/JP2016/001579

§ 371 (c)(1),
(2) Date: Aug. 14, 2017

(87) PCT Pub. No.: WO2016/152127

PCT Pub. Date: Sep. 29, 2016

(65) Prior Publication Data

US 2018/0023903 A1 Jan. 25, 2018

(30) Foreign Application Priority Data

Mar. 20, 2015 (JP) ..... 2015-057470
Mar. 15, 2016 (JP) ..... 2016-051175

(51) Int. Cl.
*F25B 9/00* (2006.01)
*F28F 1/02* (2006.01)
(Continued)

(52) U.S. Cl.
CPC ..... *F28F 9/0224* (2013.01); *F25B 39/00* (2013.01); *F25B 39/04* (2013.01); *F28F 9/0229* (2013.01);
(Continued)

(58) Field of Classification Search
CPC ..... F28F 9/0224; F28F 9/0278; F28F 9/0229; F28F 2225/08; F28F 1/022; F25B 39/00;
(Continued)

(56) References Cited

U.S. PATENT DOCUMENTS 3,866,675 A * 2/1975 Bardon ..... B21D 53/08 165/173
4,394,141 A * 7/1983 Cadars ..... F28F 9/0226 165/148
(Continued)

FOREIGN PATENT DOCUMENTS

JP 2003314987 A 11/2003
JP 2007278556 A 10/2007
(Continued)

*Primary Examiner* — Ljiljana V. Ciric
(74) *Attorney, Agent, or Firm* — Harness, Dickey & Pierce, P.L.C.

(57) ABSTRACT

A tank has a tank body defining a passage therein, a plate to which tubes are attached, and an intermediate plate. The tank body has a space defining part and a tank junction part attached to the intermediate plate. A longitudinal direction and a stacking direction of the tubes are perpendicular to a width direction. The space defining part has two end parts facing each other in the width direction and connecting to two of the tank junction part respectively. The tank body has a junction end surface that has an arc shape protruding toward the passage. The intermediate plate has a part corresponding to the junction end surface and being provided with a receiving surface that has an arc shape fitting the arc shape of the junction end surface. The receiving surface is attached to the junction end surface.

7 Claims, 6 Drawing Sheets

(51) Int. Cl.

| | |
|---|---|
| ***F28F 9/02*** | (2006.01) |
| ***F25B 39/00*** | (2006.01) |
| ***F25B 39/04*** | (2006.01) |
| ***F28D 1/053*** | (2006.01) |

(52) U.S. Cl.
CPC ..... *F28F 9/0278* (2013.01); *F25B 9/008* (2013.01); *F25B 2309/061* (2013.01); *F28D 1/05383* (2013.01); *F28F 1/022* (2013.01); *F28F 2225/08* (2013.01)

(58) Field of Classification Search
CPC .... F25B 39/04; F25B 2309/061; F25B 9/008; F28D 1/05383
See application file for complete search history.

(56) References Cited

U.S. PATENT DOCUMENTS 4,569,390 A * 2/1986 Knowlton ..... F28D 1/05366 165/149
4,936,381 A * 6/1990 Alley ..... F28F 9/0212 138/94.3
4,938,284 A * 7/1990 Howells ..... F28F 9/001 165/149
5,107,926 A * 4/1992 Calleson ..... F28D 1/05383 165/153
5,125,454 A * 6/1992 Creamer ..... F28F 9/001 165/149
5,127,466 A * 7/1992 Ando ..... F28F 9/002 165/153
5,236,042 A * 8/1993 Kado ..... F28F 9/001 165/149
5,487,422 A * 1/1996 Bertva ..... F28F 9/002 165/153
5,607,012 A * 3/1997 Buchanan ..... F28F 9/0212 165/173
5,628,361 A * 5/1997 Getto ..... F28F 9/002 165/173
5,842,515 A * 12/1998 Kim ..... B21D 53/02 165/175
6,012,513 A * 1/2000 Iokawa ..... F28F 9/001 165/149
6,035,931 A * 3/2000 Kado ..... F28F 9/0212 165/153
6,167,953 B1 * 1/2001 Kobayashi ..... F28F 9/002 165/173
6,234,238 B1 * 5/2001 Koyama ..... F28D 1/05375 165/133
6,250,381 B1 * 6/2001 Nishishita ..... F28D 1/05366 165/175
6,311,768 B1 * 11/2001 Jamison ..... F28D 1/0316 165/148
6,332,495 B1 * 12/2001 Jamison ..... F28D 1/0316 165/148
6,357,519 B1 * 3/2002 Ozaki ..... B60H 1/00328 165/135
6,364,005 B1 * 4/2002 Makino ..... F28D 1/0435 165/135
6,530,424 B2 * 3/2003 Jamison ..... F28D 1/0316 165/109.1
6,830,100 B2 * 12/2004 Gowan ..... F28F 9/0212 165/153
6,971,445 B2 * 12/2005 Lamich ..... F28F 9/001 165/153
7,044,209 B2 * 5/2006 Petersen ..... F28D 1/05375 165/173
7,059,050 B2 * 6/2006 Calhoun ..... F28D 1/05366 165/149
8,205,667 B2 * 6/2012 Yoshino ..... B23P 15/26 165/176
8,915,294 B2 * 12/2014 Mazzocco ..... F28F 9/0212 165/149
8,997,844 B2 * 4/2015 Riondet ..... F28F 9/0224 165/153
9,163,881 B2 * 10/2015 Watanabe ..... F28F 9/0217
9,551,536 B2 * 1/2017 Yamazaki ..... F28D 1/05375
9,982,952 B2 * 5/2018 Lavenu ..... F28F 9/002
2002/0139521 A1 * 10/2002 Letrange ..... F28F 9/02 165/171
2003/0037915 A1 * 2/2003 Manaka ..... F28D 1/05391 165/149
2003/0155109 A1 8/2003 Kawakubo et al.
2003/0217838 A1 * 11/2003 Dey ..... F28D 1/0535 165/173
2004/0182553 A1 * 9/2004 Seno ..... F25B 39/04 165/132
2004/0226705 A1 * 11/2004 Hiyama ..... F28F 9/0224 165/172
2005/0173100 A1 * 8/2005 Takai ..... F28F 9/0224 165/149
2006/0113069 A1 * 6/2006 Ninagawa ..... F28F 9/0224 165/149
2006/0144579 A1 * 7/2006 Ozaki ..... F28D 1/05366 165/173
2008/0223566 A1 * 9/2008 Higashiyama ..... F28D 1/05391 165/176
2009/0139703 A1 * 6/2009 Vet ..... F28F 9/0229 165/173
2009/0236086 A1 * 9/2009 Higashiyama ..... F25B 39/02 165/176
2009/0255656 A1 * 10/2009 Numasawa ..... B23K 1/0012 165/173
2013/0126126 A1 * 5/2013 Kim ..... F25B 39/04 165/104.14
2013/0160973 A1 * 6/2013 Riondet ..... F28F 9/0224 165/104.19
2013/0319644 A1 * 12/2013 Moreau ..... F28F 9/0224 165/173
2016/0054069 A1 * 2/2016 Armsden ..... F28D 7/0066 165/173
2016/0097597 A1 4/2016 Ishizaka
2016/0102925 A1 * 4/2016 McWain ..... F28F 9/0226 165/173

FOREIGN PATENT DOCUMENTS

JP 2007278557 A 10/2007
JP 2009293815 A 12/2009
JP 2014219174 A 11/2014

* cited by examiner

TANK AND HEAT EXCHANGER

CROSS REFERENCE TO RELATED APPLICATIONS

This application is a U.S. National Phase Application under 35 U.S.C. 371 of International Application No. PCT/JP2016/001579 filed on Mar. 18, 2016 and published in Japanese as WO 2016/152127 A1 on Sep. 29, 2016. This application is based on and claims the benefit of priority from Japanese Patent Application No. 2015-057470 filed on Mar. 20, 2015 and Japanese Patent Application No. 2016-051175 filed on Mar. 15, 2016, The entire disclosures of all of the above applications are incorporated herein by reference.

Technical Field

The present disclosure relates to a tank in which a fluid flows and a heat exchanger having the tank.

Background Art

Conventionally, a refrigeration cycle using carbon dioxide as refrigerant is known. The refrigeration cycle has a refrigerant radiator (i.e., a heat exchanger for radiating heat). Since a pressure in the refrigeration cycle becomes high, components configuring the refrigerant radiator are required to have pressure resistance. Especially, a tank is required to have higher pressure resistance since the tank has the largest passage sectional area in the refrigerant radiator, as described in Patent Literature 1.

Then, a heat exchanger having a tank that is configured by three members of a tank body, a plate, and an intermediate plate is disclosed (e.g., refer to Patent Literature 2). The refrigerant flows in the tank body. The plate is connected with tubes. The intermediate plate has a plate shape and is arranged between the tank body and the plate. According to the above-described configuration having the three members, a junction area between each of the three members can be secured easily, and thereby the tank can have greater pressure resistance as a whole.

PRIOR ART LITERATURES

Patent Literature

Patent Literature 1: JP 2003-314987 A
Patent Literature 2: JP 2007-278556 A

SUMMARY OF INVENTION

According to studies conducted by the inventors of the present disclosure, the tank body of the tank disclosed in Patent Literature 1 may be made by pressing. In this case, a shear drop having an arc shape in cross section is formed in a corner of the junction area between the tank body and the intermediate plate. The sear drop of the tank body is stressed intensively when an inner pressure of the tank increases, and thereby the pressure resistance of the tank may deteriorate.

Accordingly, it is required to suppress the sear drop to reduce the stress applied to the sear drop intensively. For example, the shape of the corner of the junction area in cross section is necessary to be a square shape substantially. However, the pressing is required to be performed repeatedly so as to prevent the sear drop from being formed in the pressing. As a result, a quantity of machining processes increases, and thereby productivity may deteriorate.

The present disclosure addresses the above-described issues, and it is an objective of the present disclosure to provide a tank that can have pressure resistance certainly while improving productivity.

It is another objective to provide a heat exchanger having the tank that can have pressure resistance certainly while improving productivity.

According to a first aspect of the present disclosure, a tank has a passage in which a fluid flows. The passage and insides of tubes in which the fluid flows communicate with each other. The tubes are stacked in a stacking direction.

The tank has a tank body, a plate, and an intermediate plate. The tank body defines the passage therein. The tubes are attached to the plate. The intermediate plate has a plate shape and is arranged between the tank body and the plate. Each of the tubes has a longitudinal end in a longitudinal direction of the tubes. The longitudinal end connects to the passage through a communicating portion that is located between the passage and the longitudinal end. The passage has a round part having a round shape in cross section when viewed in the stacking direction. The round part includes at least a top located away from the tubes. The tank body has a space defining part and a tank junction part. The space defining part defines the passage. The tank junction part has a plate shape and is attached to the intermediate plate.

The longitudinal direction and the stacking direction of the tubes are perpendicular to a width direction. The space defining part has two end parts facing each other in the width direction. The two end parts connect to two of the tank junction part respectively. The space defining part has an inner wall surface on a side adjacent to the passage. The inner wall surface has a top located furthermost from the tubes in the inner wall surface. The tank body has a junction area in which the space defining part connects to the tank junction part. The junction area has a junction edge located closest to the tubes in the junction area when viewed in the stacking direction. The tank body has a shape satisfying expressions given by $D1>D2$ and $D2\times L\geq A1$. D1 represents a diameter of an inscribed circle including the top of the space defining part of the tank body when viewed in the stacking direction. D2 represents a distance between the two junction edges facing each other in the width direction in the tank body when viewed in the stacking direction. L represents a length of the passage in the stacking direction. A1 represents a total area of passage sectional areas of the tubes.

As described above, the tank body has a shape satisfying the expressions given by $D1>D2$ and $D2\times L\geq A1$. Accordingly, it can suppress that stress is intensively applied to the junction part in which the space defining part connects to the tank junction part, i.e., to a corner of a junction part in which the tank body is attached to the intermediate part. In addition, a pressing process is not necessary to provide the junction area in which the space defining part connects to the tank junction part to have a square shape, thereby a quantity of machining processes can be reduced. Therefore, the tank can have high pressure resistance certainly while productivity is improved.

According to a second aspect of the present disclosure, a tank has a passage in which a fluid flows. The passage and insides of tubes in which the fluid flows communicate with each other. The tubes are stacked in a stacking direction.

The tank has a tank body, a plate, and an intermediate plate. The tank body defines the passage therein. The tubes are attached to the plate. The intermediate plate has a plate shape and is arranged between the tank body and the plate.

Each of the tubes has a longitudinal end in a longitudinal direction of the tubes. The longitudinal end connects to the passage through a communicating portion that is located between the passage and the longitudinal end. The passage has a round part having a round shape in cross section when viewed in the stacking direction. The round part includes at least a top located away from the tubes. The tank body has a space defining part and a tank junction part. The space defining part defines the passage. The tank junction part has a plate shape and is attached to the intermediate plate.

The longitudinal direction and the stacking direction of the tubes are perpendicular to a width direction. The space defining part has two end parts facing each other in the width direction. The two end parts connect to two of the tank junction part respectively. The tank body has a junction end surface that has an arc shape protruding toward the passage when viewed in the stacking direction. The junction end surface is located adjacent to the passage and included in a junction area in which the space defining part connects to the tank junction part. The intermediate plate has a part corresponding to the junction end surface. The part is provided with a receiving surface that has an arc shape fitting the arc shape of the junction end surface. The receiving surface is attached to the junction end surface.

According to the second aspect, an inner wall surface of the tank body smoothly joins an inner side of the intermediate plate in a manner that the intermediate plate has a receiving surface that has the arc shape fitting the arc shape of the junction end surface. Accordingly, it can suppress that stress is intensively applied to the junction part in which the space defining part connects to the tank junction part, i.e., to a corner of a junction part in which the tank body is attached to the intermediate part. In addition, a pressing process is not necessary to provide the junction area in which the space defining part connects to the tank junction part to have a square shape, thereby a quantity of machining processes can be reduced. Therefore, the tank can have high pressure resistance certainly while productivity is improved.

According to a third aspect of the present disclosure, a heat exchanger has tubes, a pair of tanks, an inlet, and an outlet. The tubes are stacked in a stacking direction and define conduits in which a fluid flows respectively. Each of the tubes therein defines a passage in which a fluid flows. The pair of tanks extends in the stacking direction. The tubes connect the pair of tanks to each other. The inlet guides the fluid to flow into at least one tank of the pair of tanks. The outlet guides the fluid to flow out of the one tank.

Each of the pair of tanks has a plate, a tank body, and an intermediate plate. One longitudinal ends of the tubes are attached to the plate. The tank body is attached to the plate and has a passage extending in the stacking direction. The intermediate plate has a plate shape and is arranged between the tank body and the plate.

The tank body has a space defining part, a tank junction part, and an opening. The space defining part defines the passage such that at least a part of the passage has a round shape in cross section when viewed in the stacking direction. The tank junction part is attached to the intermediate plate. The tank junction part extends in a width direction perpendicular to both the stacking direction and a longitudinal direction of the tubes when viewed in the stacking direction. The space defining part has two end parts facing each other in the width direction. The two end parts connect to two of the tank junction parts respectively. The opening is defined between the two of the tank junction parts in the width direction. Insides of the tubes and the passage communicate with each other through the opening. At least the one tank has a tank inlet part that distributes the fluid, flowing from the inlet, to the plurality of tubes.

The tank body has a shape satisfying expressions given by: $D1>D2$ and $D2\times L\geq A\times n$. D1 represents a diameter of a largest inscribed circle in cross sections of the passage when viewed in the stacking direction. D2 represents a width of the opening in the width direction. L represents a length of the tank inlet part in the passage in the stacking direction. A represents a passage sectional area of each of the tubes connecting to the tank inlet part. The n represents a quantity of the tubes connecting to the tank inlet part.

According to the third aspect, it can be provide the heat exchanger that has the tank having high pressure resistance certainly while productivity is improved.

According to a fourth aspect of the present disclosure, a heat exchanger has tubes and a pair of tanks. The tubes are stacked in a stacking direction and define conduits in which a fluid flows respectively. Each of the pair of tanks extends in the stacking direction. The tubes connect the pair of tanks to each other.

Each of the pair of tanks has a plate, a tank body, and an intermediate plate. One longitudinal ends of the tubes are attached to the plate. The tank body is attached to the plate and has a passage extending in the stacking direction. The intermediate plate has a plate shape and is arranged between the tank body and the plate.

The tank body has a space defining part, a tank junction part, and an opening. The space defining part defines the passage such that at least a part of the passage has a round shape in cross section when viewed in the stacking direction. The tank junction part is attached to the intermediate plate. The tank junction part extends in a width direction perpendicular to both the stacking direction and a longitudinal direction of the tubes when viewed in the stacking direction. The space defining part has two end parts facing each other in the width direction. The two end parts connecting to two of the tank junction parts respectively. The opening is defined between the two of the tank junction parts in the width direction. Insides of the tubes and the passage communicate with each other through the opening. The intermediate plate has a plate hole through which the tubes and the passage communicate with each other.

The tank body has a shape satisfying expressions given by: $D1>D2$ and $D2\times t1\geq A\times n$. D1 represents a diameter of a largest inscribed circle in cross sections of the passage when viewed in the stacking direction. D2 represents a width of the opening in the width direction. t1 represents a thickness dimension of the plate hole in the stacking direction. A represents a passage sectional area of each of the tubes connecting to the tank inlet part.

Therefore, a heat exchanger that has the tank having high pressure resistance certainly while productivity is improved can be provided.

According to a fifth aspect of the present disclosure, a heat exchanger has tubes and a pair of tanks. The tubes are stacked in a stacking direction and define conduits in which a fluid flows respectively. The pair of tanks extends in the stacking direction. The tubes connect the pair of tanks to each other.

Each of the pair of tanks has a plate, a tank body, and an intermediate plate. One longitudinal ends of the tubes are attached to the plate. The tank body is attached to the plate and has a passage extending in the stacking direction. The intermediate plate has a plate shape and is arranged between the tank body and the plate.

The tank body has a space defining part and a tank junction part. The space defining part defines the passage such that at least a part of the passage has a round shape in cross section when viewed in the stacking direction. The tank junction part is attached to the intermediate plate. The tank junction part extends in a width direction perpendicular to both the stacking direction and a longitudinal direction of the tubes when viewed in the stacking direction. The space defining part has two end parts facing each other in the width direction. The two end parts connect to two of the tank junction parts respectively.

The tank body has a junction end surface that has an arc shape protruding toward the passage when viewed in the stacking direction. The junction end surface is located adjacent to the passage and included in a junction area in which the space defining part connects to the tank junction part. The intermediate plate has a part corresponding to the junction end surface. The part is provided with a receiving surface that has an arc shape fitting the arc shape of the junction end surface. The receiving surface is attached to the junction end surface.

According to the fifth aspect, a heat exchanger that has the tank having high pressure resistance certainly while productivity is improved can be provided.

BRIEF DESCRIPTION OF DRAWINGS

The above and other objects, features and advantages of the present disclosure will become more apparent from the following detailed description made with reference to the accompanying drawings.

DESCRIPTION OF EMBODIMENTS

Embodiments of the present disclosure will be described hereafter referring to drawings. In the embodiments, a part that corresponds to or equivalents to a matter described in a preceding embodiment may be assigned with the same reference number, and a redundant description may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

A first embodiment will be described hereafter referring to FIG. 1 through FIG. 6. According to the present embodiment, a tank of the present disclosure is applied to a header tank of a refrigerant radiator that is disposed in a supercritical refrigeration cycle using carbon dioxide ($CO_2$) as refrigerant. The supercritical refrigeration cycle is a refrigeration cycle that may use, other than carbon dioxide, ethylene, ethane, nitric oxide etc. as the refrigerant. A pressure on a high-pressure side in the supercritical refrigeration cycle exceeds a critical pressure of the refrigerant.

Figure 1:
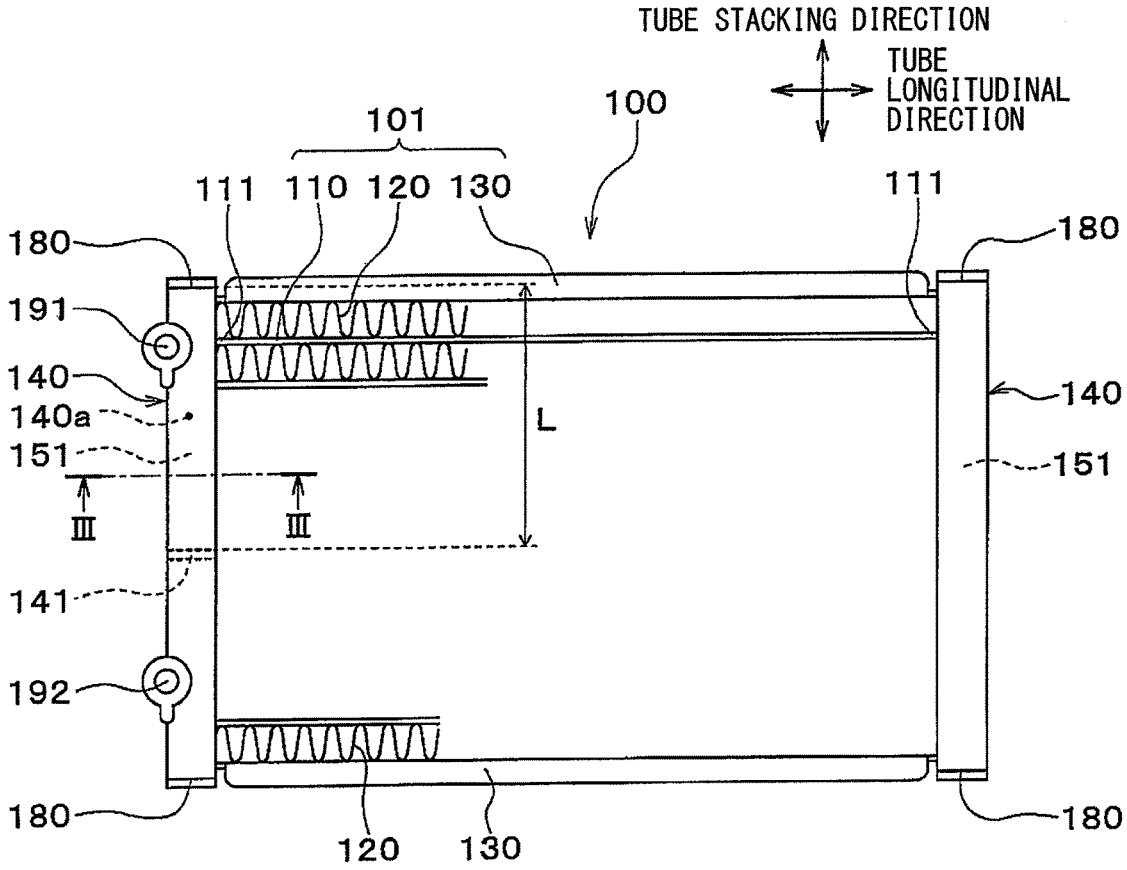
FIG. 1 is a front view illustrating a refrigerant radiator according to a first embodiment.

As shown in FIG. 1, a refrigerant radiator 100 is a heat exchanger that performs a heat exchange between the refrigerant flowing in tubes 110 and air flowing outside the tubes 110. According to the present embodiment, the refrigerant corresponds to a fluid, and the air corresponds to another fluid.

The refrigerant radiator 100 has a core 101 and a pair of header tanks 140. Each member configuring the core 101 and the pair of header tanks 140 is made of aluminum or an aluminum alloy. The members configuring the core 101 and the pair of header tanks 140 are assembled by a method such as fitting and a fixing using a jig and are joined together by brazing. A brazing material is applied to surfaces of the members as required in advance.

The core 101 has the tubes 110 and fins 120. The tubes have a flat shape in cross section and define conduits in which refrigerant flows respectively. The fins 120 have a corrugated shape. The tubes 110 and the fins 120 are stacked alternately with each other.

A longitudinal direction of the tubes 110 will be referred to as a tube longitudinal direction hereafter. A stacking direction in which the tubes 110 and the fins 120 are stacked will be referred to as a tube stacking direction. A direction perpendicular to both the tube longitudinal direction and the tube stacking direction will be referred to as a width direction.

Figure 2:
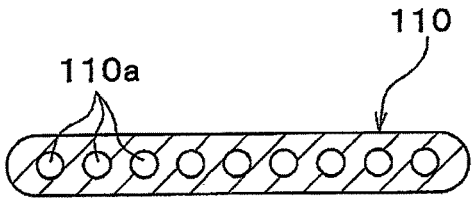
FIG. 2 is a cross-sectional view illustrating tubes taken along a line perpendicular to a longitudinal direction of the tubes according to the first embodiment.

Each of the tubes 110 has conduits 110*a* therein. The conduits 110*a* are arranged in a longitudinal direction of the flat shape of the tubes 110. Specifically, as shown in FIG. 2, a quantity of the conduits 110*a* provided in each of the tubes 110 is nine, and the conduits 110*a* has a circular shape in cross section. Accordingly, a passage sectional area A of each of the tubes 110 is equal to a total area of passage sectional areas of the conduits 110*a*. That is, when each of the tubes 110 has a single conduit, the passage sectional area A of each of the tubes 110 is equal to a passage sectional area of the single conduit. The tubes 110 are formed by extrusion molding.

As shown in FIG. 1, the core 101 has two edges facing each other in the tube stacking direction, and a side plate 130 is attached to each of the two edges. The side plate 130 reinforces the core 101. The side plate 130 extends parallel to the tube longitudinal direction and has two end parts in the tube longitudinal direction. The two end parts are attached to the header tanks 140 respectively.

The header tanks 140 are located on both sides of the tubes 110 in the tube longitudinal direction respectively, and extend in a direction (i.e., the tube stacking direction) perpendicular to the tube longitudinal direction. The header tanks 140 communicate with the tubes 110. According to the present embodiment, the header tanks 140 are located on horizontal sides of the tubes 110 facing each other in horizontal direction, and extend in vertical direction to communicate with the tubes 110.

More specifically, each of the header tanks 140 has a passage 151 therein. The header tanks 140 and the tubes 110 are coupled with each other by brazing such that an inside of the passage 151 and insides of the tubes 110 communicate with each other. Each of the header tanks 140 has longitudinal ends (i.e., ends in the tube stacking direction), and an end cap 180 is attached to each of the longitudinal ends by brazing. The end cap 180 seals an opening of the passage 151 provided in the header tanks 140.

One header tank 140 of the pair of header tanks 140 has a separator 141. The separator 141 is located in the one header tank 140 and partitions the passage 151. The separator 141 is attached to the one header tank 140 by brazing. The one header tank 140 is located on a left side on a condition of being illustrated in FIG. 1. The one header tank 140 has an inlet joint 191. The inlet joint 191 is located above the separator 141 and attached to the one header tank 140 by brazing. The inlet joint 191 provides an inlet, and the refrigerant flows into the passage 151 from the inlet. The one header tank 140 further has an outlet joint 192. The outlet joint 192 is located below the separator 141 and attached to the one header tank 140 by brazing. The outlet joint 192 provides an outlet, and the refrigerant flows out of the passage 151 from the outlet.

Figure 3:
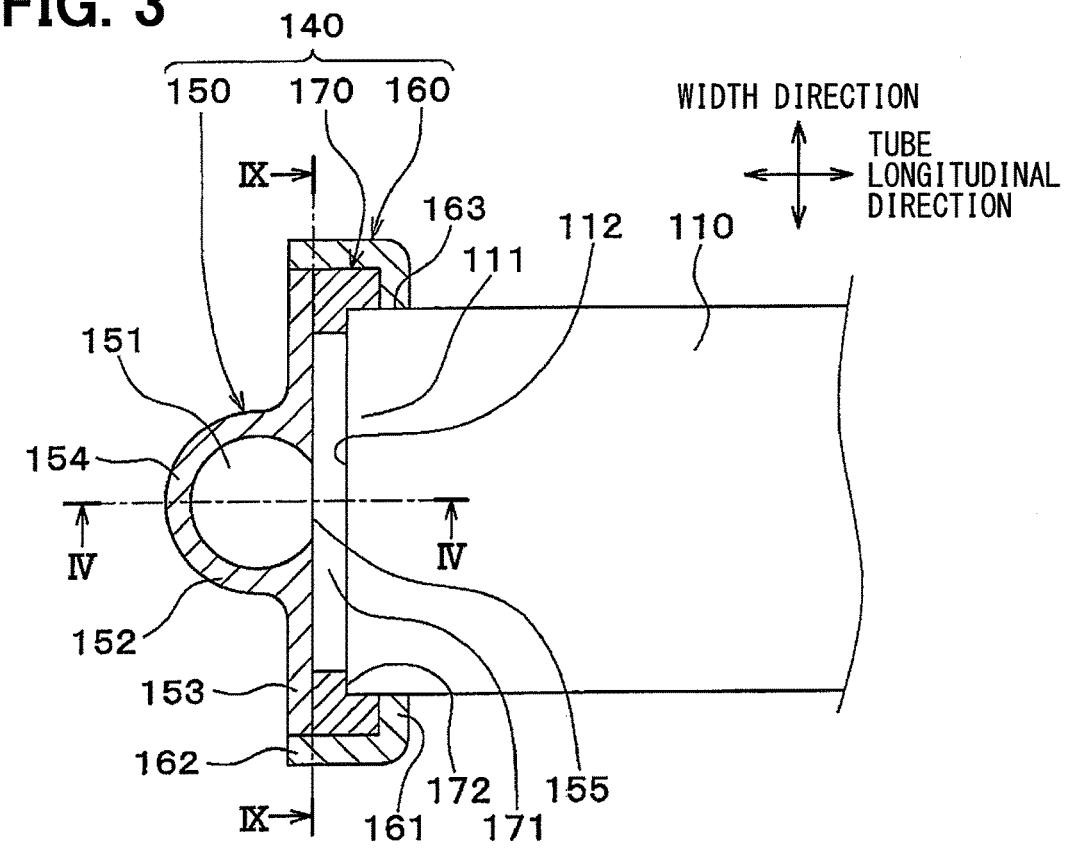
FIG. 3 is a cross-sectional view taken along a line III-III shown in FIG. 1.
Figure 4:
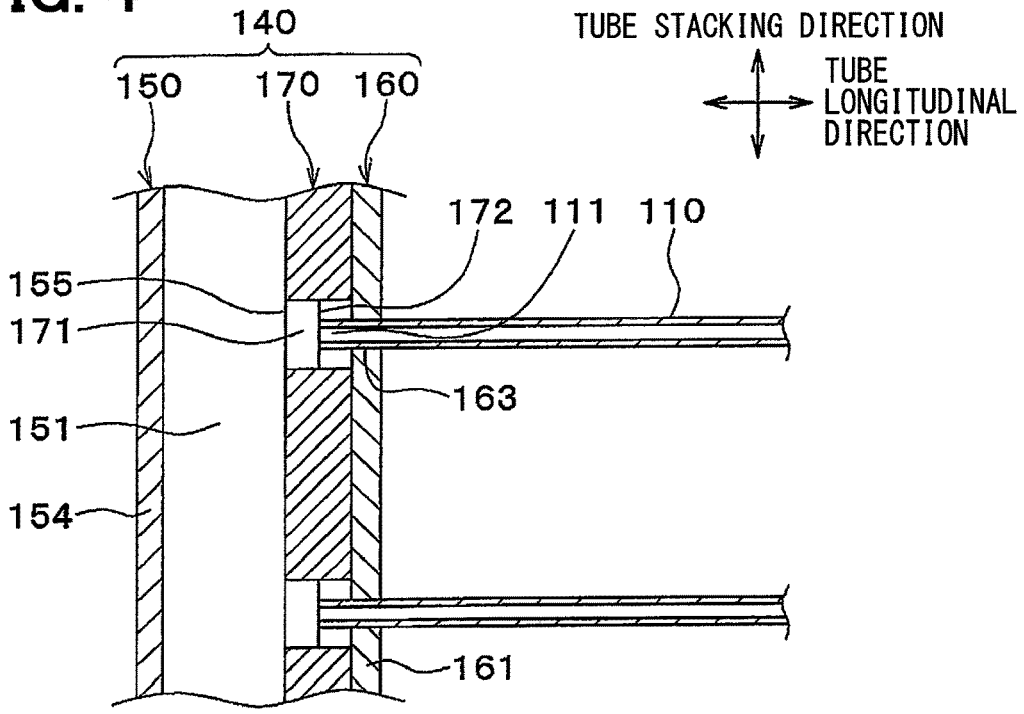
FIG. 4 is a cross-sectional view taken along a line IV-IV shown in FIG. 3.
Figure 5:
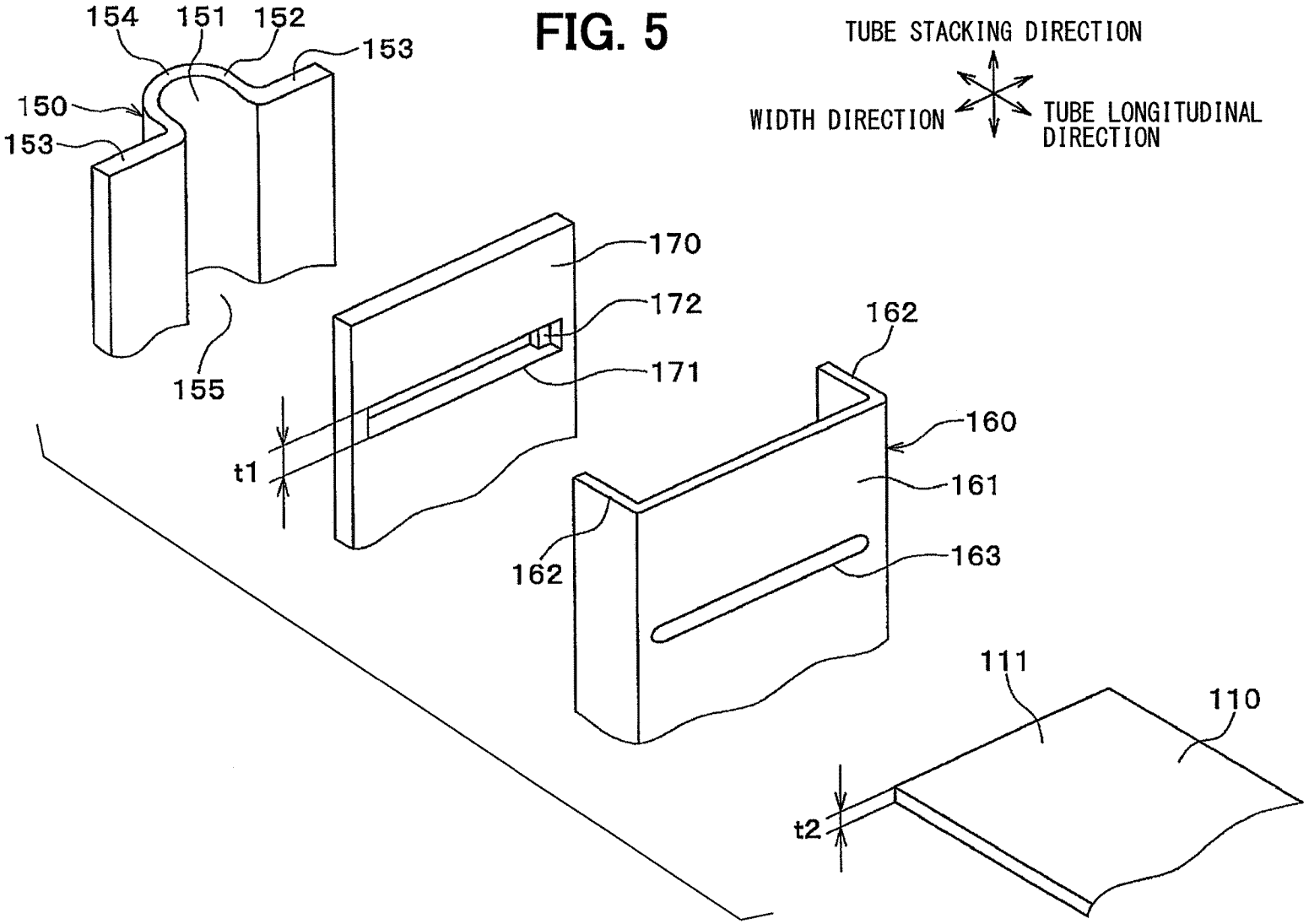
FIG. 5 is an exploded perspective view illustrating one of the tubes and a header tank according to the first embodiment.

A configuration of the header tanks 140 of the present embodiment will be described in detail hereafter. As shown in FIG. 3, FIG. 4, and FIG. 5, each of the header tanks 140 has a tank body 150, a plate 160, and an intermediate plate 170. The tank body defines the passage 151, in which the refrigerant flows, therein. The tubes 110 are attached to the plate 160. The intermediate plate 170 has a plate shape and is arranged between the tank body 150 and the plate 160.

The tank body 150 has a space defining part 152 and a tank junction part 153. The space defining part 152 defines the passage 151. The tank junction part 153 is attached to the plate 160 and the intermediate plate 170.

As shown in FIG. 3 and FIG. 4, the space defining part 152 has a substantially arc shape in cross section when viewed in the tube stacking direction. That is, the space defining part 152 is provided such that at least a part of an inner wall surface of the space defining part 152 has substantially arc shape. The inner wall surface is, i.e., a surface adjacent to the passage 151. Accordingly, the passage 151 has a round part that has a round shape and includes a top 154 located furthermost from the tubes 110, in cross section of the passage 151 viewed in the tube stacking direction.

The space defining part 152 has an opening 155 on a side adjacent to the tubes 110 (i.e., a side adjacent to the intermediate plate 170). One longitudinal ends of the tubes 110 in the longitudinal direction and the passage 151 communicate with each other through the opening 155. The one longitudinal ends of the tubes 110 will be referred to as tube ends 111 hereafter.

The space defining part 152 has two ends facing each other in the width direction. The tank junction part 153 has a plate shape and connects the two ends to each other. In other words, the space defining part 152 has one end and an other end facing each other in the width direction, and the tank junction part 153 connects to each of the one end and the other end. As a result, the opening 155 is located between two of the tank junction part 153 when viewed in the tube stacking direction. The space defining part 152 and the tank junction part 153 are provided integrally with each other.

The tank body 150 having the above-described space defining part 152 and the tank junction part 153 is provided by pressing a flat plate that is cladded with (i.e., coated with) a brazing material in advance. The brazing material covers a surface of the flat plate on the side adjacent to the tubes 110. The brazing material may cover the one surface and another surface of the flat plate facing the one surface.

The plate 160 has a substantially U-shape. Specifically, the plate 160 has two bent portions extending in one direction when viewed in the tube stacking direction. More specifically, the plate 160 has a flat part 161 and ribs 162. The flat part 161 has a rectangular flat shape and has two ends facing each other in the width direction. The ribs 162 connect to the two ends of the flat part 161 respectively. The flat part 161 and the ribs 162 are provided integrally with each other.

The flat part 161 of the plate 160 is provided with a tube insert hole 163 to which the tube end 111 is inserted. The plate 160 is provided by pressing a flat plate that is cladded with a brazing material on both of a top side and a bottom side facing each other.

The intermediate plate 170 has a rectangular flat shape. The intermediate plate 170 has a part corresponding to the tube end 111, and the part is provided with a plate hole 171 passing through the intermediate plate 170 in a thickness direction of the intermediate plate 170. As shown in FIG. 5, the plate hole 171 has a longitudinal end part provided with a stepped portion 172. The stepped portion 172 is provided as a position setting portion that sets a position of the tube end 111 in the thickness direction.

A thickness dimension t1 of the plate hole 171 in the thickness direction is larger than a thickness dimension t2 of the each tube 110 in the thickness direction. The dimension t1 is, i.e., a length of the plate hole 171 in the tube stacking direction. The thickness dimension t2 is, i.e., a dimension of each tube 110 in a transverse direction in the flat cross-sectional shape or a length of each tube 110 in the tube stacking direction. According to the present embodiment, the thickness dimension t1 is about twice as large as of the thickness dimension t2. The intermediate plate 170 is different from the tank body 150 and the plate 160 in a point that the intermediate plate 170 is configured by a bare member of which surface is not cladded.

The tank body 150, the intermediate plate 170, plate 160, and the tubes 110 having the above-described configurations are assembled as shown in FIG. 3 and FIG. 4. A location of an edge 112 of the tube end 111 is set to be located in an area outside the passage 151 by the stepped portion 172 of the plate hole 171 provided in the intermediate plate 170. The tube end 111 is located inside the plate hole 171.

The opening 155 of the tank body 150 and the plate hole 171 of the intermediate hole 170 provide a communicating portion through which the tube end 111 connects to the passage 151. The members 150, 170, 160, 110 are brazed integrally by a brazing material applied to the tank body 150 and the plate 160.

The tank body 150 of the present embodiment will be described in detail hereafter referring to FIG. 6. The tank body 150 has a surface adjacent to the passage 151 defining a junction area in which the space defining part 152 connects to the tank junction part 153. The surface will be referred to as a junction end surface 156.

Figure 6:
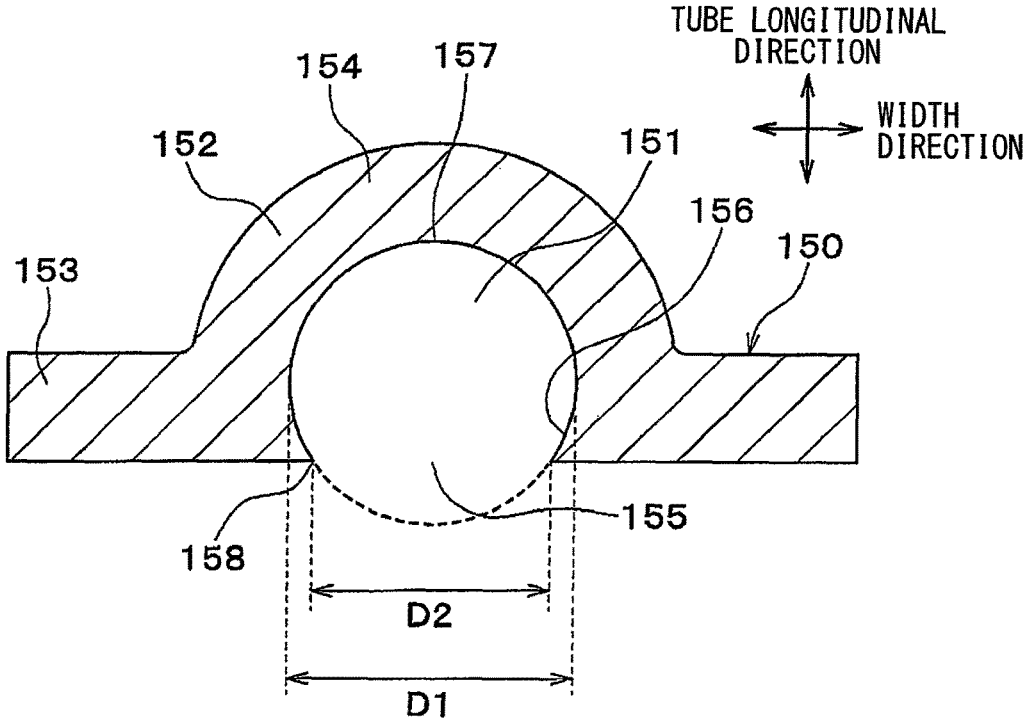
FIG. 6 is a cross-sectional view illustrating a tank body when viewed in a tube stacking direction, according to the first embodiment.

The junction end surface 156 inclines from an inside to an outside in the width direction (i.e., from an inside to an outside of a paper showing FIG. 6) as being distanced away from the tube 110 in the tube longitudinal direction (from a lower side to an upper side of the paper showing FIG. 6). According to the present embodiment, the junction end surface 156 has an arc shape that is recessed toward the outside in the width direction. More specifically, the junction end surface 156 is located on a circle defined by the inner wall surface of the space defining part 152 having the substantially arc shape. Therefore, the junction end surface 156 and the inner wall surface (i.e., an arc surface) connect to each other smoothly.

The inner wall surface of the space defining part 152 included in the tank body 150 has a top 157 located furthermost from the tube end 111. The tank body 150 has the junction area in which the space defining part 152 connects to the tank junction part 153. The junction area has a junction edge 158 located closest to the tube end 111 when viewed in the tube stacking direction. Since the junction end surface 156 has the arc shape, the junction end surface 156 has one edge and an other edge facing each other in the width direction. According to the present embodiment, each of the one edge and the other edge has the junction edge 158.

Here, D1 represents a diameter of an inscribed circle (shown by a dashed line in FIG. 6) including the top 157 of the space defining part 152 when viewed in the stacking direction. In other words, D1 represents a diameter of an inscribed circle having the largest diameter in the passage 151 when viewed in the tube stacking direction.

D2 represents a distance between the two junction edges 158 of the tank body 150 facing each other in the width direction when viewed in the stacking direction. That is, D2 represents a distance between the junction edge 158 provided in the one edge and the junction edge 158 provided in the other edge in the width direction. In other words, D2 represents a width of the opening 155.

L represents a length of the passage 151 in the stacking direction. Specifically, the header tank 140 has a tank inlet part 140*a* that distributes the fluid, flowing from the inlet joint 191, to the tubes 110. According to the present embodiment, the tank inlet part 140*a* is a part of the one header tank 140 and is located above the separator 141. As shown in FIG. 1, the length L is, i.e., a length of the tank inlet part 140*a* in the passage 151 in the tube stacking direction.

A1 represents a total area of passage sectional areas of the tubes 110. Specifically, a passage sectional area A of each of the tubes 110 multiplied by a quantity n of the tubes 110 attached to the tank inlet part 140*a* equals the total area A1 of the passage sectional areas (i.e., $A \times n = A1$). The tank body 150 of the present embodiment has a shape satisfying expressions of $D1 > D2$ and $D2 \times L \geq A1$ (i.e., $D2 \times L \geq A \times n$).

As described above, the tank body 150 is configured to satisfy the expression of $D1 > D2$.

Accordingly, it can suppress that a sear drop is formed in a corner of a junction area in which the space defining part 152 and the tank junction part 153 connect to each other, i.e., in which the tank body 150 is attached to the intermediate plate 170. Therefore, it can suppress that stress is applied to the sear drop intensively even when a pressure inside the header tank 140 increases.

In addition, the pressing is not required to be performed repeatedly so as to provide the junction area, in which the space defining part 152 connects to the tank junction part 153, to be a square shape when providing the tank body 150 by pressing. Accordingly, a deterioration of the productivity can be suppressed. Therefore, the header tank 140 of the present embodiment can certainly have high pressure resistance while productivity is improved.

Moreover, a pressure inside the tank body 150 applies a stress to the junction edge 158 in a direction in which the junction edge 158 is pressed against intermediate plate 170 by configuring the tank body 150 to satisfy the expression of $D1 > D2$. The direction in which junction edge 158 is pressed against the intermediate plate 170 is, i.e., a radial outward direction of the inscribed circle of the passage 151 shown by the dashed line in FIG. 6. As a result, the tank body 150 and the intermediate plate 170 can be prevented from being separated from each other even when the brazing between the tank body 150 and the intermediate plate 170 is insufficient. Therefore, the pressure resistance can be secured certainly.

Here, an opening area of the opening 155 of the tank body 150 becomes small when the distance (D2) between the junction edges 158, adjacent to each other in the width direction when viewing the tank body 150 in the tube stacking direction, is set too small. In this case, a pressure loss of the fluid flowing in or flowing out of the passage 151 may increase.

According to the present embodiment, the tank body 150 has a shape satisfying an expression of $D2 \times L \geq A1$. As a result, the opening area ($D2 \times L$) of the opening 155, which is an inlet/outlet of the tank body 150 with respect to the passage 151, can be larger than or equal to the total area (A1) of the passage sectional areas of the tubes 110. Therefore, an increase of the pressure loss of the fluid flowing in or flowing out of the passage 151 can be suppressed.

(Second Embodiment)

A second embodiment will be described hereafter referring to FIG. 7. The second embodiment is different from the above-described first embodiment in configurations of the tank body 150 and the intermediate plate 170.

Figure 7:
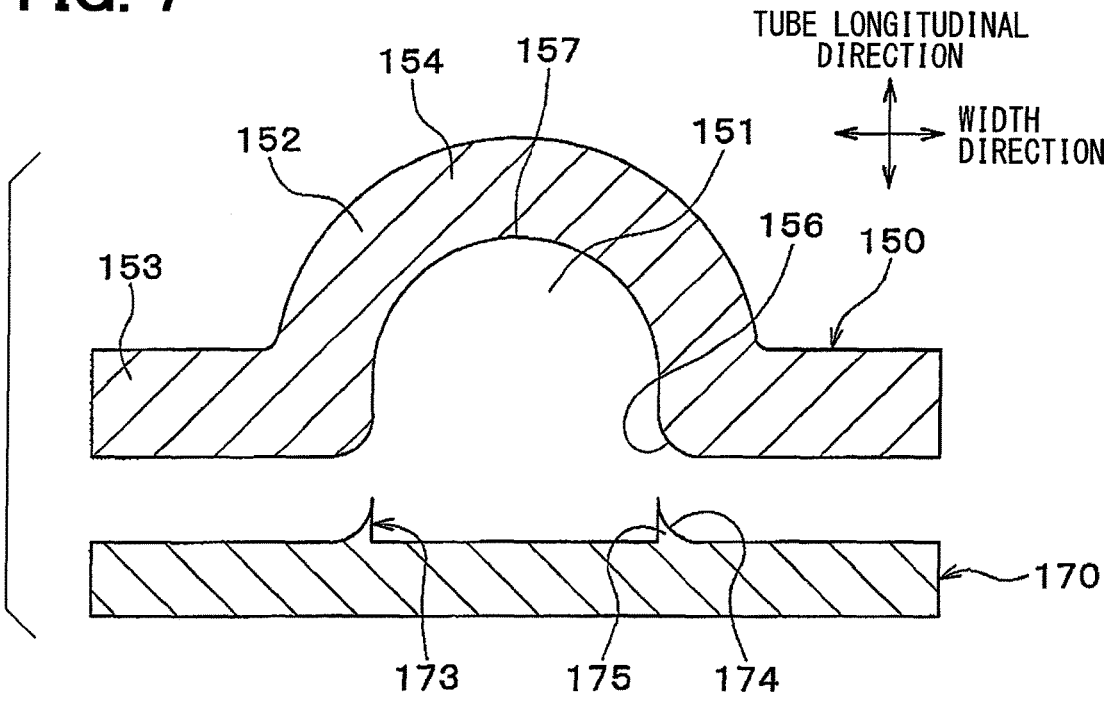
FIG. 7 is an exploded cross-sectional view illustrating a tank body and an intermediate plate when viewed in the tube stacking direction, according to a second embodiment.

As shown in FIG. 7, the space defining part 152 of the tank body 150 has substantially a U-shape in a cross section when viewed in the tube stacking direction. The junction end surface 156 of the tank body 150 has an arc shape protruding toward the passage 151.

The intermediate plate 170 has the part corresponding to the junction end surface 156. The part is provided with a protruding portion 173 that protrudes toward the tank body 150 (i.e., upward in a paper showing FIG. 7). The protruding portion 173 has substantially a triangular shape in a cross section when viewed in the tube stacking direction. The protruding portion 173 has a receiving surface 174 and a vertical surface 175. The receiving surface 174 is attached to the junction end surface 156 of the tank body 150. The receiving surface 175 is perpendicular to the width direction.

The receiving surface 174 has an arc shape fitting the arc shape of the junction end surface 156. That is, the receiving surface 174 has the same arc shape as that of the junction end surface 156.

The vertical surface 175 connects to an edge of the receiving surface 174 on a side adjacent to the tank body 150. The vertical surface 175 connects to the inner wall surface of the space defining part 152 smoothly. That is, the vertical surface 175 and the inner wall surface of the space defining part 152 provide a seamless single flat surface. In other words, the vertical surface 175 and the inner wall surface of the space defining part 152 connect to each other without providing any step.

As described above, the protruding portion 173 of the intermediate plate 170 is provided with the receiving surface 174 having the arc shape fitting the arc shape of the junction end surface 156 of the tank body 150. Accordingly, the inner wall surface of the tank body 150 and an inner wall surface of the intermediate plate 170 can connect to each other smoothly.

Accordingly, it can suppress that an insufficient junction part is formed in the junction part in which the space defining part 152 connects to the tank junction part 153, i.e., in a corner of a junction part in which the tank body 150 is attached to the intermediate part 170. Therefore, it can suppress that stress is intensively applied to the corner of the junction part in which the tank body 150 is attached to the intermediate part 170 when the pressure inside the header tank 140 increases.

In addition, the pressing process is not necessary to provide the junction area in which the space defining part 152 connects to the tank junction part 153 to have a square shape, thereby a quantity of machining processes can be reduced. Therefore, the header tank 140 of the present embodiment can certainly have high pressure resistance while productivity is improved.

(Third Embodiment)

A third embodiment will be described hereafter referring to FIG. 8. The third embodiment is different from the second embodiment in a configuration of the intermediate plate 170.

Figure 8:
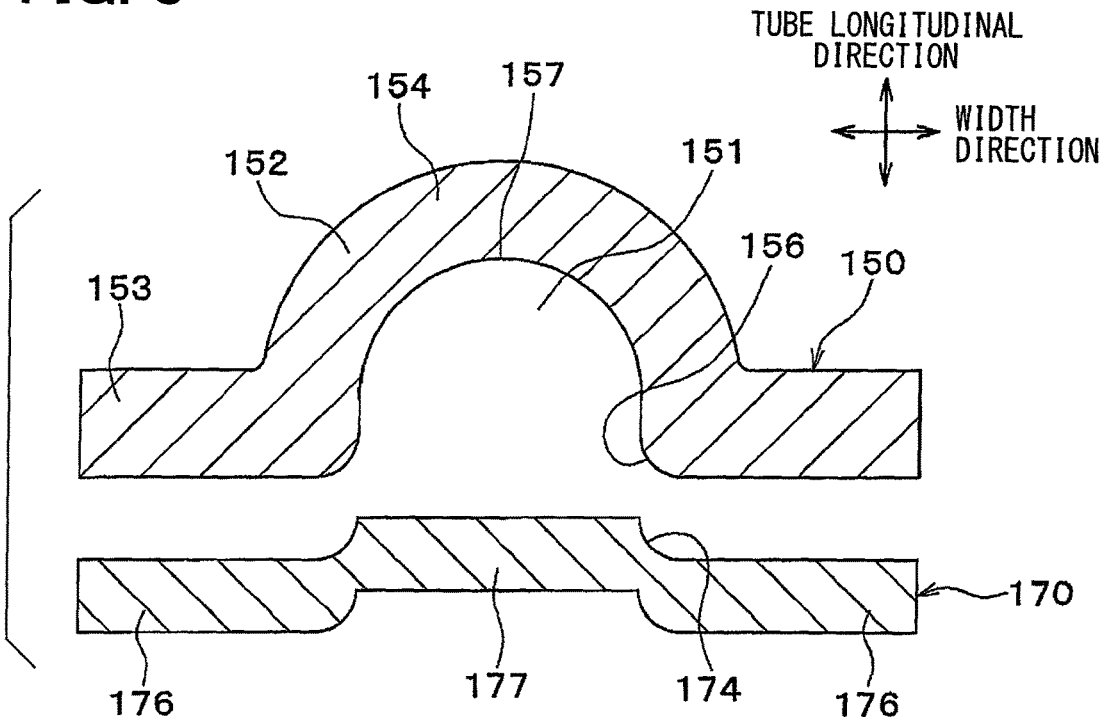
FIG. 8 is an exploded cross-sectional view illustrating a tank body and an intermediate plate when viewed in the tube stacking direction, according to a third embodiment.

As shown in FIG. 8, the intermediate plate 170 of the present embodiment has an intermediate junction part 176 and a protruding part 177. The intermediate junction part 176 is attached to the tank junction part 153 of the tank body 150. The protruding part 177 is located closer to the top 154 of the tank body 150 as compared to the intermediate junction part 176. The intermediate junction part 176 and the protruding part 177 have a plate shape extending in a direction perpendicular to the tube stacking direction. The intermediate junction part 176 is provided integrally with the protruding part 177.

The protruding part 177 has the plate hole 171. That is, the protruding part 177 is provided with a communicating portion through which the tube end 111 connects to the passage 151.

The protruding part 177 has two edges facing each other in the width direction, and two of the intermediate junction parts 176 connect to the two edges of the protruding part 177 respectively. The intermediate junction part 176 and the protruding part 177 connect to each other in a junction. A surface of the junction adjacent to the tank body 150 is attached to the junction end surface 156. Accordingly, the surface of the junction in which the intermediate junction part 176 and the protruding part 177 connect to each other configures the receiving surface 174 that is attached to the junction end surface 156 of the tank body 150.

As described above, according to the present embodiment, the intermediate junction part 176 and the protruding part 177 connect to each other in the junction. The junction has the receiving surface 174 having the arc shape fitting the arc shape of the junction end surface 156 of the tank body 150. As a result, the inner wall surface of the tank body 150 and the inner wall surface of the intermediate plate 170 can connect to each other smoothly, thereby the same effects as the second embodiment can be obtained.

(Fourth Embodiment)

Figure 9:
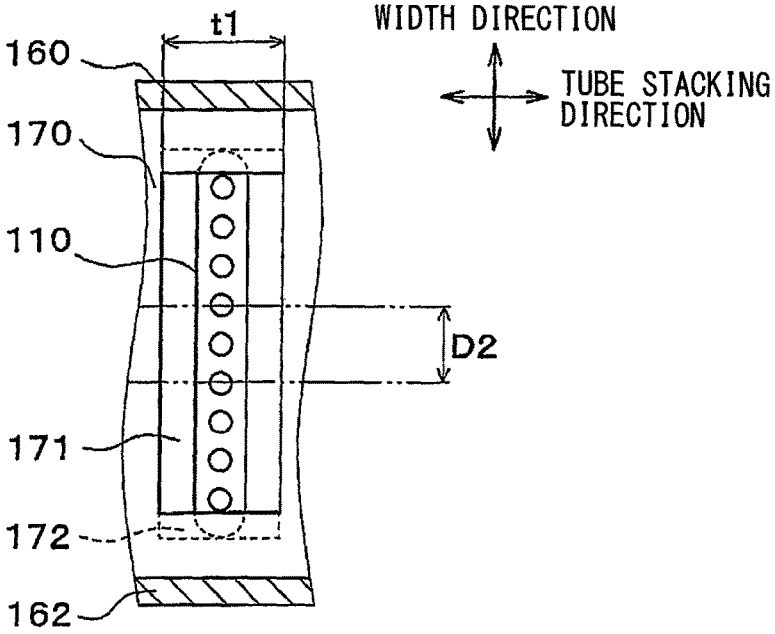
FIG. 9 is a cross-sectional view illustrating a header tank according to a fourth embodiment.

According to the present embodiment, a distance D2 between the junction edges 158 of the tank body 150 in the width direction, a thickness dimension t1 of the plate hole 171, and the passage sectional area A of each of the tubes 110 are defined as shown in FIG. 9. FIG. 9 illustrates a diagram corresponding to a cross sectional view taken along a line IX-IX shown in FIG. 3 regarding the first embodiment.

Specifically, the header tank 140 of the present embodiment has a shape satisfying an expression of $D2 \times t1 \geq A$. That is, the header tank 140 of the present embodiment has the shape satisfying expressions of $D1 > D2$, $D2 \times L \geq A \times n$, and $D2 \times t1 \geq A$. Other configurations of the refrigerant radiator 100 are the same as the first embodiment.

Therefore, according to the header tank 140 and the refrigerant radiator 100 of the present embodiment, the same effects as the first embodiment can be obtained.

The communicating part 155, 171 has a part to which one tube 110 is connected. An opening area (expressed by $D2 \times t1$) of the part can be set larger than the passage sectional area A of each of the tubes 110. As a result, an increase of a pressure loss caused when the refrigerant flows into the passage 151 from the tubes 110 can be suppressed more effectively. Alternatively, an increase of a pressure loss caused when the refrigerant flows into the tubes 110 from the passage 151 can be suppressed more effectively.

(Fifth Embodiment)

The present embodiment is different from the third embodiment in a configuration of the intermediate plate 170 in the header tank 140.

Figure 10:
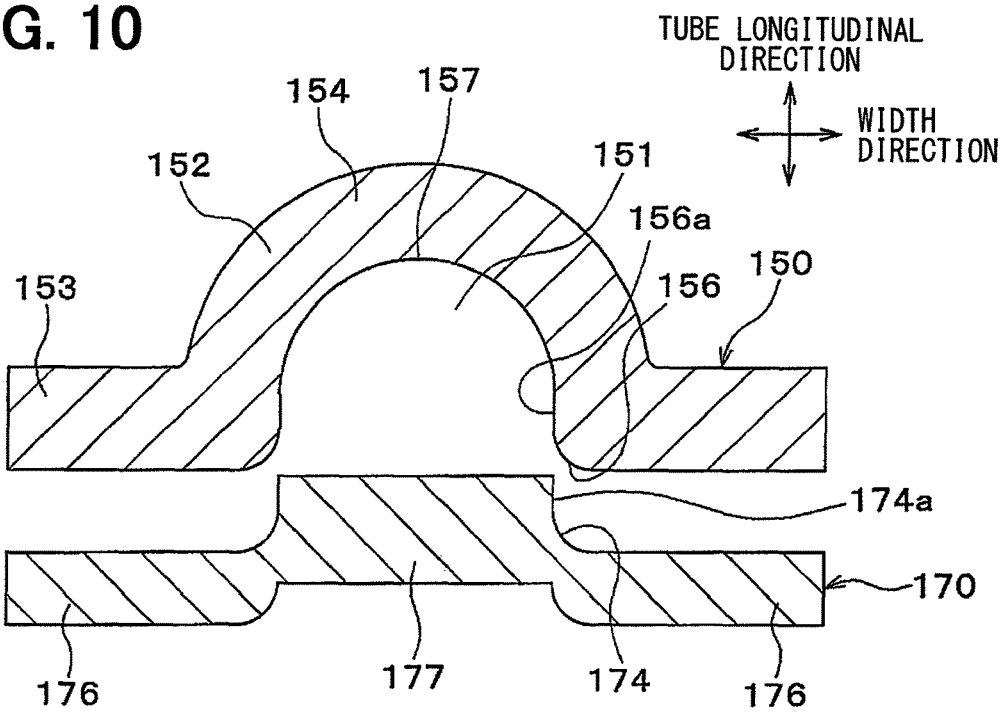
FIG. 10 is an exploded cross-sectional view illustrating a tank body and an intermediate plate when viewed in the tube stacking direction, according to a fifth embodiment.

Specifically, according to the present embodiment, the protruding part 177 of the intermediate plate 170 protrudes toward the passage 151 over the end of the receiving surface 174 adjacent to the passage 151 as shown in FIG. 10. The protruding part 177 has side surfaces facing each other in the width direction, and the side surfaces has flat surfaces 174*a* respectively. The flat surfaces 174*a* are attached to the inner wall surface of the space defining part 152 by brazing. FIG. 10 illustrates a cross-sectional view corresponding to the cross-sectional view in FIG. 8 regarding the third embodiment.

The flat surfaces 174*a* expand parallel to the tube stacking direction and the tube longitudinal direction. The inner surface of the space defining part 152 has flat surfaces 156*a* to which the flat surfaces 174*a* are attached respectively. Other configurations of the refrigerant radiator 100 are the same as the first embodiment.

Therefore, according to the header tank 140 and the refrigerant radiator 100 of the present embodiment, the same effects as the third embodiment can be obtained.

Moreover, the flat surfaces 174*a* of the protruding part 177 are attached to the inner wall surface of the space defining part 152, in addition to the attachment between the tank junction part 153 of the tank body 150 and the intermediate junction part 176 of the intermediate plate 170. The junctions can cover the junction end surface 156 in which the sear drop is easily formed by the pressing. As a result, stress can be prevented, more effectively, from being applied intensively to the corner of the junction area in which the tank body 150 is attached to the intermediate plate 170 when the pressure inside the header tank 140 increases.

(Modifications)

It should be understood that the present disclosure is not limited to the above-described embodiments and intended to cover various modification within a scope of the present disclosure, for example, as described hereafter. It should be understood that structures described in the above-described embodiments are preferred structures, and the present disclosure is not limited to have the preferred structures. The scope of the present disclosure includes all modifications that are equivalent to descriptions of the present disclosure or that are made within the scope of the present disclosure.

(1) According to the above-described embodiments, three components (the tank body 150, the plate 160, and the intermediate plate 170) configuring the header tank 140 are assembled (fixed temporary) by a method such as fitting or fixing using a jig, and then joined together by brazing. However, a method for joining the three components 150, 160, and 170 are not limited to the above-described example.

Figure 11:
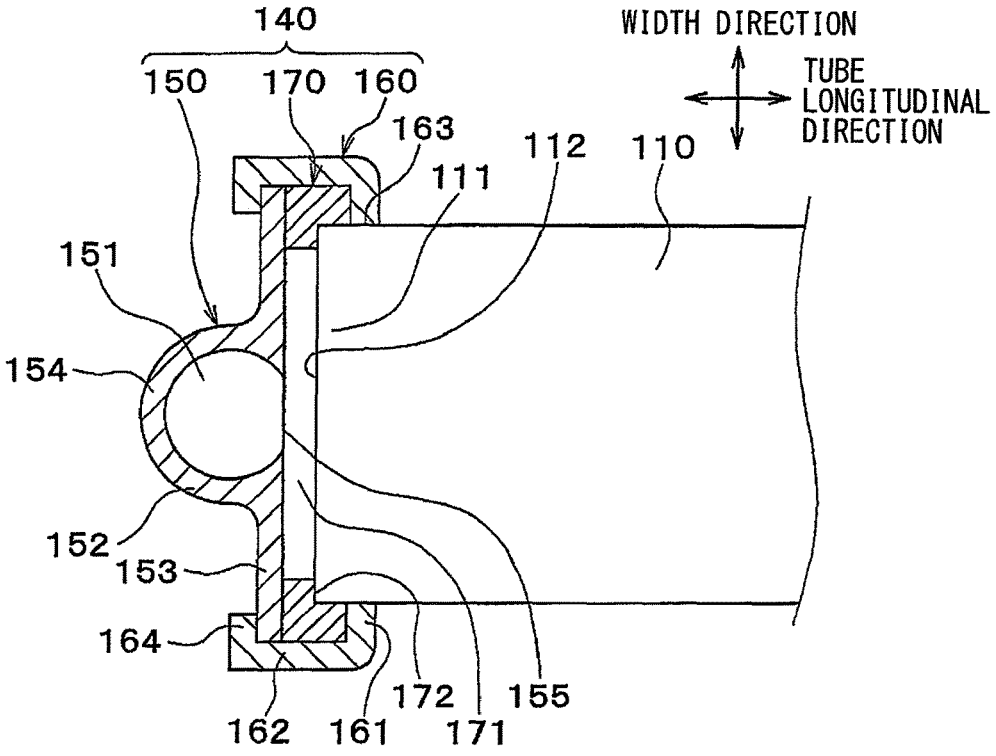
FIG. 11 is a cross-sectional view illustrating one of tubes and a header tank when viewed in the tube stacking direction, according to a modification.

For example, as shown in FIG. 11, the ribs 162 of the plate 160 may have clicks 164 as a swaging part. In this case, the three components 150, 160, 170 are deformed plastically and fixed temporary by the clicks 164, and then joined together by brazing.

(2) According to the above-described first embodiment, the tank body 150 is formed by pressing. However, the tank body 150 may be formed by extrusion molding.

(3) According to the above-described embodiment, single passage 151 of the header tank 140 is provided, and any other passage 151 is arranged adjacent to the single passage 151 in the width direction. However, more than one of the passage 151 may be arranged in the width direction similar to the tubes 110.

(4) According to the above-described embodiments, the tank of the present disclosure is applied to the refrigerant radiator 100 disposed in the supercritical refrigeration cycle. However, the tank of the present disclosure may be applied to an evaporator that evaporates the refrigerant. Alternatively, the tank of the present disclosure may be applied to a heat exchanger for a vehicle engine etc. Furthermore, the refrigerant cycle is not limited to the supercritical refrigeration cycle using carbon dioxide as the refrigerant, and may be a normal refrigeration cycle. The tank of the present disclosure may be applied to a device other than the heat exchanger.

(5) According to the above-described embodiments, both the inlet joint 191 and the outlet join 192 are attached to the one header tank 140. However, the inlet joint 191 may be attached to the one header tank 140, and the outlet joint 192 may be attached to the other header tank 140. That is, the inlet joint 191 and the outlet join 192 may be attached to different header tanks 140 respectively.

What is claimed is:

1. A tank having a passage in which a fluid flows, the passage communicating with insides of a plurality of tubes in which the fluid flows, the plurality of tubes being stacked in a stacking direction, the tank comprising:

a tank body that defines the passage therein;

a plate to which the plurality of tubes are attached; and an intermediate plate that has a plate shape and is arranged between the tank body and the plate, wherein each of the plurality of tubes has a longitudinal end in a longitudinal direction of the plurality of tubes, the longitudinal end connecting to the passage through a communicating portion that is located between the passage and the longitudinal end, the passage has a round part having a round shape in cross section when viewed in the stacking direction, the round part including at least a top located away from the plurality of tubes, the tank body has a space defining part that defines the passage and a tank junction part that has a plate shape and is attached to the intermediate plate, the longitudinal direction and the stacking direction of the plurality of tubes are perpendicular to a width direction, the space defining part has two end parts facing each other in the width direction, the two end parts connecting to two of the tank junction part respectively, the tank body has a junction end surface that has an arc shape protruding toward the passage when viewed in the stacking direction, the junction end surface being located adjacent to the passage and included in a junction area in which the space defining part connects to the tank junction part, and the intermediate plate has a part corresponding to the junction end surface, the part being provided with a receiving surface that has an arc shape fitting the arc shape of the junction end surface, the receiving surface being attached to the junction end surface.

2. The tank according to claim 1, wherein the part of the intermediate plate corresponding to the junction end surface is provided with a protruding portion protruding toward the tank body, and the protruding portion has the receiving surface.

3. The tank according to claim 1, wherein the intermediate plate has an intermediate junction part that has a plate shape and is attached to the tank junction part of the tank body and a protruding part that has a plate shape and located closer to the top as compared to the intermediate junction part, the protruding part is provided with the communicating portion, and the intermediate junction part connects to the protruding part in a junction area having the receiving surface.

4. The tank according to claim 1, wherein the tank is used in a heat exchanger that performs a heat exchange between the fluid flowing in the plurality of tubes and another fluid flowing outside the plurality of tubes.

5. The tank according to claim 1, further comprising a swaging part that fixes the tank body, the plate, and the intermediate plate together temporarily, wherein the tank body, the plate, and the intermediate plate are joined together by brazing.

6. A heat exchanger comprising:

a plurality of tubes being stacked in a stacking direction and defining conduits in which a fluid flows respectively; and a pair of tanks that extends in the stacking direction, the plurality of tubes connecting the pair of tanks to each other, wherein each of the pair of tanks has a plate to which one longitudinal ends of the plurality of tubes are attached, a tank body that is attached to the plate and has a passage extending in the stacking direction, and an intermediate plate that has a plate shape and is arranged between the tank body and the plate, the tank body has a space defining part that defines the passage such that at least a part of the passage has a round shape in cross section when viewed in the stacking direction, and a tank junction part being attached to the intermediate plate, the tank junction part extending in a width direction perpendicular to both the stacking direction and a longitudinal direction of the plurality of tubes when viewed in the stacking direction, the space defining part having two end parts facing each other in the width direction, the two end parts connecting to two of the tank junction parts respectively, the tank body has a junction end surface that has an arc shape protruding toward the passage when viewed in the stacking direction, the junction end surface being located adjacent to the passage and included in a junction area in which the space defining part connects to the tank junction part, and the intermediate plate has a part corresponding to the junction end surface, the part being provided with a receiving surface that has an arc shape fitting the arc shape of the junction end surface, the receiving surface being attached to the junction end surface .

7. The heat exchanger according to claim 6, wherein the intermediate plate has an intermediate junction part that has a plate shape and is attached to the tank junction part of the tank body and a protruding part that has a plate shape and protrudes toward the passage to be located closer to the passage as compared to the intermediate junction part, the intermediate junction part connects to the protruding part in a junction area having the receiving surface, and the protruding part has flat surfaces that face each other in the width direction and that are attached to an inner wall surface of the space defining part.

* * * * *